US006862790B2

(12) United States Patent
Kato

(10) Patent No.: US 6,862,790 B2
(45) Date of Patent: Mar. 8, 2005

(54) DIMPLING DEVICE

(75) Inventor: Hiroshi Kato, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 177 days.

(21) Appl. No.: 10/209,919

(22) Filed: Aug. 2, 2002

(65) Prior Publication Data

US 2003/0037420 A1 Feb. 27, 2003

(30) Foreign Application Priority Data

Aug. 2, 2001 (JP) ..... 2001-234870

(51) Int. Cl.[7] ..... B23P 19/04

(52) U.S. Cl. ..... 29/264; 29/258; 29/263; 29/283.5; 72/355.4; 72/417; 72/454; 81/463

(58) Field of Search ..... 81/463; 72/417, 72/471, 355.4, 335, 454; 29/509, 524.1, 525.01, 525.05, 525.06, 798, 243.5, 243.53, 283.5, 258, 263, 264; 227/69, 53, 60

(56) References Cited

U.S. PATENT DOCUMENTS 2,292,446 A * 8/1942 Huck ..... 72/340
2,333,418 A * 11/1943 Fischer ..... 72/358
2,344,944 A * 3/1944 Hurst ..... 72/322
2,353,450 A * 7/1944 Fischer ..... 72/312
2,353,451 A * 7/1944 Fischer ..... 72/358
2,365,918 A * 12/1944 Tuttle ..... 72/358
2,410,476 A * 11/1946 Appleton ..... 72/125
2,423,957 A * 7/1947 Amtsberg ..... 72/358
2,431,935 A * 12/1947 Huck ..... 72/355.4
2,455,903 A * 12/1948 Fischer ..... 72/466.9
2,478,382 A * 8/1949 Fischer ..... 81/128
2,501,576 A * 3/1950 Novy ..... 72/124
2,641,378 A * 6/1953 Wilt ..... 72/391.8
3,091,277 A * 5/1963 Schmitt ..... 72/313
4,339,859 A * 7/1982 Weld ..... 29/894.342
4,445,264 A * 5/1984 Banerian ..... 29/445
4,858,289 A 8/1989 Speller, Sr.

* cited by examiner

*Primary Examiner*—Eric Compton
(74) *Attorney, Agent, or Firm*—Birch, Stewart, Kolasch & Birch, LLP

(57) ABSTRACT

A dimpling device is provided with a slide rod, a first workpiece holder, and a second workpiece holder. The slide rod is slidably fitted around a center pin running through rivet holes. The first workpiece holder is slidably and detachably fitted around the slide rod. The second workpiece holder is detachably fixed to the center pin. The first and second workpiece holders have holding surfaces with curvatures that have been preselected to conform to the curvatures of the surfaces of workpieces. The slide rod has a punch and the second workpiece holder has a die. When the workpieces are held together by the holding surfaces, a nut is rotated to move the punch into a cooperative relationship with the die, thereby dimpling the surroundings of the rivet holes.

13 Claims, 12 Drawing Sheets

R
12
R
9
12
64
12a
63
11
11a
53
56
50
55
52
57
50a
9
43
47
58
59
44
60
46
61
45
48
49
44a

DIMPLING DEVICE

CROSS-REFERENCES TO RELATED APPLICATIONS

This nonprovisional application claims priority under 35 U.S.C. §119(a) on patent application Ser. No. 2001-234870 filed in Japan on Aug. 2, 2001, the entirety of which is herein incorporated by reference.

BACKGROUND OF THE INVENTION

1. Field of the Invention

The present invention relates to a dimpling device for dimpling the surroundings of rivet holes; and more particularly to a dimpling device for dimpling the surroundings of rivet holes preformed in workpieces into dish shapes to fasten superimposed workpieces with a flush rivet.

2. Description of the Background Art

In the background art, a flush rivet having a frustoconical head that is used as a rivet for fastening a skin of an airplane to an inner frame of the airplane suffers from a low air resistance. However, the present inventor has determined that it is necessary to dimple the surroundings of rivet holes when using this type of flush rivet. The rivet holes are preformed in the skin and the inner frame that are to be fastened together, e.g., preformed into dish shapes so as to form a recess which receives the frustoconical head of the flush rivet.

A flush rivet dimpling device of the background art is shown and described in U.S. Pat. No. 4,858,289 to Speller, Sr., the entire contents of which are hereby incorporated by reference.

SUMMARY OF THE INVENTION

The dimpling of the surroundings of a rivet hole is carried out by pressing using a punch and a die. The present inventor has determined that it is necessary to fix the workpiece by holding the surroundings of the rivet hole with a workpiece holder when pressing with a punch and die combination. However, since the workpiece holder in the above-mentioned device is shaped so as to hold a flat workpiece, there is a possibility that distortion in the shape of the workpiece may be caused by the workpiece holder when it holds a workpiece formed from a complex curved surface, e.g., such as a skin of an airplane.

In order to avoid these problems, the curvature of the holding surface of the workpiece holder can be made to conform to that of the workpiece. However, this type of arrangement is limited in application since it is difficult to accommodate workpieces having various curvatures. Accordingly, the multi-purpose features of the dimpling device is lost with this type of solution.

The present invention overcomes the shortcomings associated with the background art and achieves other advantages not realized by the background art. The present invention has been achieved under the above-mentioned circumstances.

It is an object of the present invention to provide a dimpling device that can accommodate workpieces having various curvatures while preventing distortion of the workpiece during manufacture and handling.

One or more of these objects are accomplished by a dimpling device for dimpling surrounding areas of rivet holes preformed in superimposed first and second workpieces into dish shapes in order to fasten the superimposed workpieces by a flush rivet, the dimpling device comprising a center pin capable of being inserted into the rivet holes of the workpieces and having a tip end; a punch slidably fitted around an outer periphery of the center pin and capable of making contact with a working surface of the first workpiece; a first workpiece holder slidably and detachably fitted around an outer periphery of the punch and having a holding surface capable of making contact with the working surface of the first workpiece without an appreciable gap therebetween; a second workpiece holder detachably engaged with the tip end of the center pin and having a holding surface capable of making contact with a working surface of the second workpiece without any appreciable gap therebetween; a die integrally formed with the second workpiece holder and cooperatively engaging the punch during a dimpling operation; means for driving the workpiece holders for making the first workpiece holder and the second workpiece holder approach each other along an axial direction of the center pin, wherein the working surfaces of the first and second workpieces are held therebetween; and means for driving the center pin for moving the center pin in the axial direction so as to dimple the surrounding areas of the rivet holes with the punch and the die into dish shapes.

One or more of these objects are accomplished by a dimpling device for dimpling an outer periphery of a rivet hole formed in a first and second workpiece into a frustoconical shape for receiving a flush rivet, the dimpling device comprising a center pin having an outer periphery and a tip end; a punch slidably fitted around the outer periphery of the center pin and capable of making contact with a surface of a workpiece having the rivet hole, the punch having an outer periphery; a first workpiece holder slidably and detachably fitted around the outer periphery of the punch and having a holding surface capable of making contact with the surface of the first workpiece; a second workpiece holder detachably fixed to the tip end of the center pin and having a holding surface capable of making contact with a surface of the second workpiece; a die integrally formed with the second workpiece holder and cooperatively engaging the punch during a dimpling operation; a workpiece holder driving device for driving the first and second workpiece holders and securing the first and second workpieces, the means for driving making the first workpiece holder and the second workpiece holder approach each other along an axial direction of the center pin so as to secure the surfaces of the first and second workpieces; and a center pin driving device for moving the center pin along the axial direction so as to dimple the outer periphery of the rivet holes with the punch and the die during the dimpling operation.

One or more of these objects are accomplished by a method of dimpling rivet holes in the first and second workpieces with the dimpling devices described hereinabove, including preparing in advance a set of first and second workpiece holders having curvatures along their respective holding surfaces conforming with corresponding curvatures of the first and second workpieces in the vicinity of the rivet holes; and dimpling the rivet holes with the dimpling device with the set of first and second workpiece holders and the punch and die.

In accordance with the above-mentioned arrangement, when making the punch and the die approach each other along the center pin inserted into the rivet holes of the workpieces and dimpling the surroundings of the rivet holes into dish shapes, the holding surface of the first workpiece holder and the holding surface of the second workpiece holder make contact with the surface of one workpiece and the surface of the other workpiece without any appreciable gap therebetween.

Therefore, even when the workpieces have a curvature in the vicinity of the rivet holes, it is possible to prevent the workpieces from deforming in those portions where they are in contact with the holding surfaces. Furthermore, since the first workpiece holder and the second workpiece holder are detachable from the center pin, the first workpiece holder and the second workpiece holder can be preselected to have holding surfaces with a curvature corresponding to the curvature of the workpieces to be machined, thereby improving the multi-purpose feature of the dimpling device.

Since the second workpiece holder is detachable from the tip end of the center pin, after removing the second workpiece holder from the center pin and inserting the center pin into the rivet holes from the surface on one side of the workpieces, the second workpiece holder can be attached to the tip end of the center pin from the surface on the opposite side of the workpieces. Therefore, dimpling of the surroundings of rivet holes positioned away from the outer peripheries of the workpieces can be carried out without problems.

In accordance with this arrangement, since the vicinity of the rivet holes of the workpieces may also be heated by a heater unit, it is possible to reduce the load that is required to plastically deform the workpieces when pressing using the punch and die, thereby improving the workability. In accordance with a third aspect of the present invention, there is proposed a dimpling device wherein a plurality of sets of the first workpiece holder and the second workpiece holder having holding surfaces with different curvatures are prepared in advance, and a set of the first workpiece holder and the second workpiece holder is selected for use according to the curvature of the vicinity of the rivet holes of the workpieces.

Since a set of workpiece holders is selected for use according to the curvature of the vicinity of the rivet holes of the workpieces, from the plurality of pre-prepared sets of first workpiece holders and second workpiece holders whose holding surfaces have varying curvatures, it is possible to accommodate workpieces having various curvatures with relative ease, while thereby further improving the multi-purpose applicability of the dimpling device.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

DETAILED DESCRIPTION OF THE PREFERRED EMBODIMENTS

Figure 1:
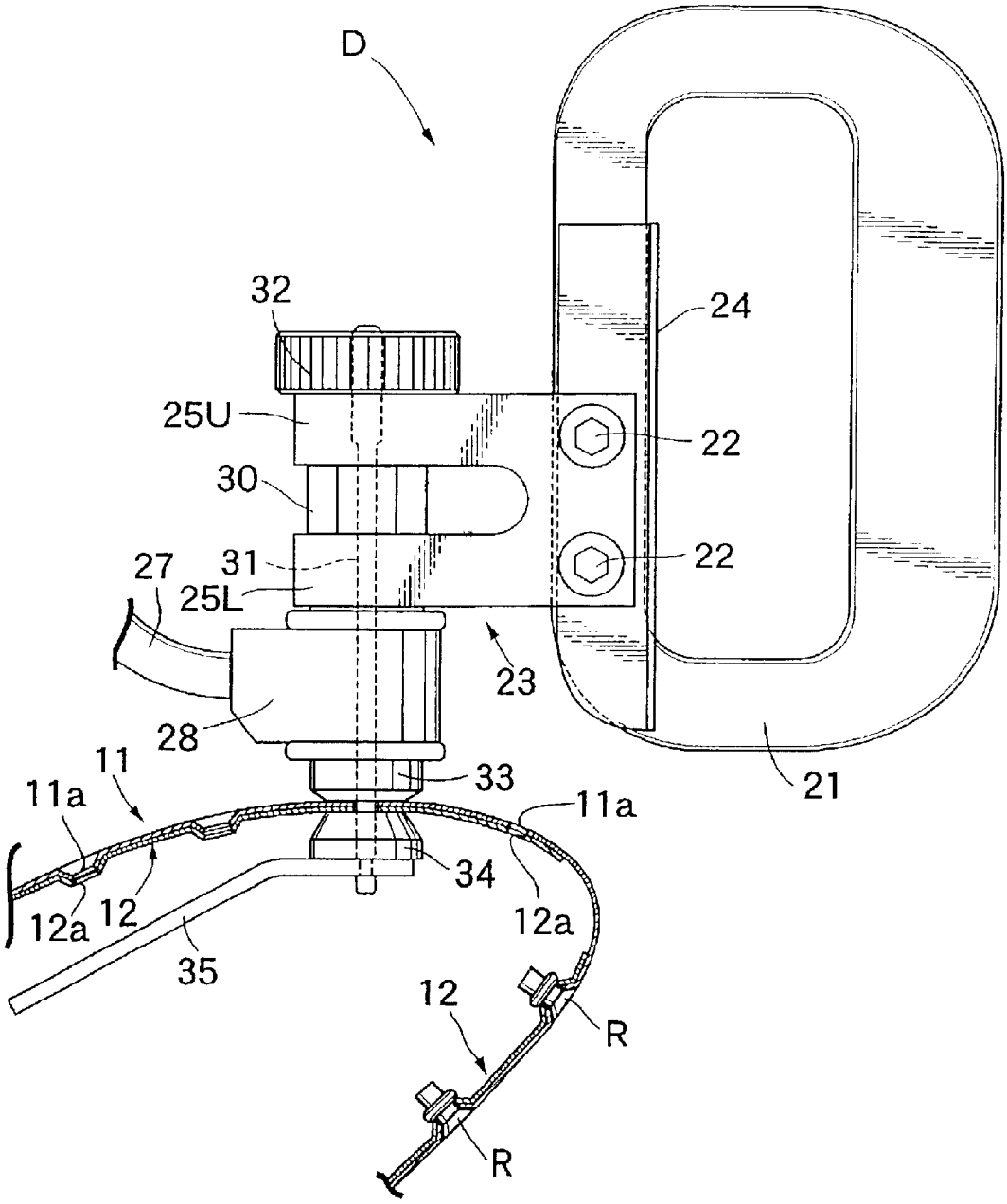
FIG. 1 is a side view of a dimpling device according to a first embodiment of the present invention.
Figure 2:
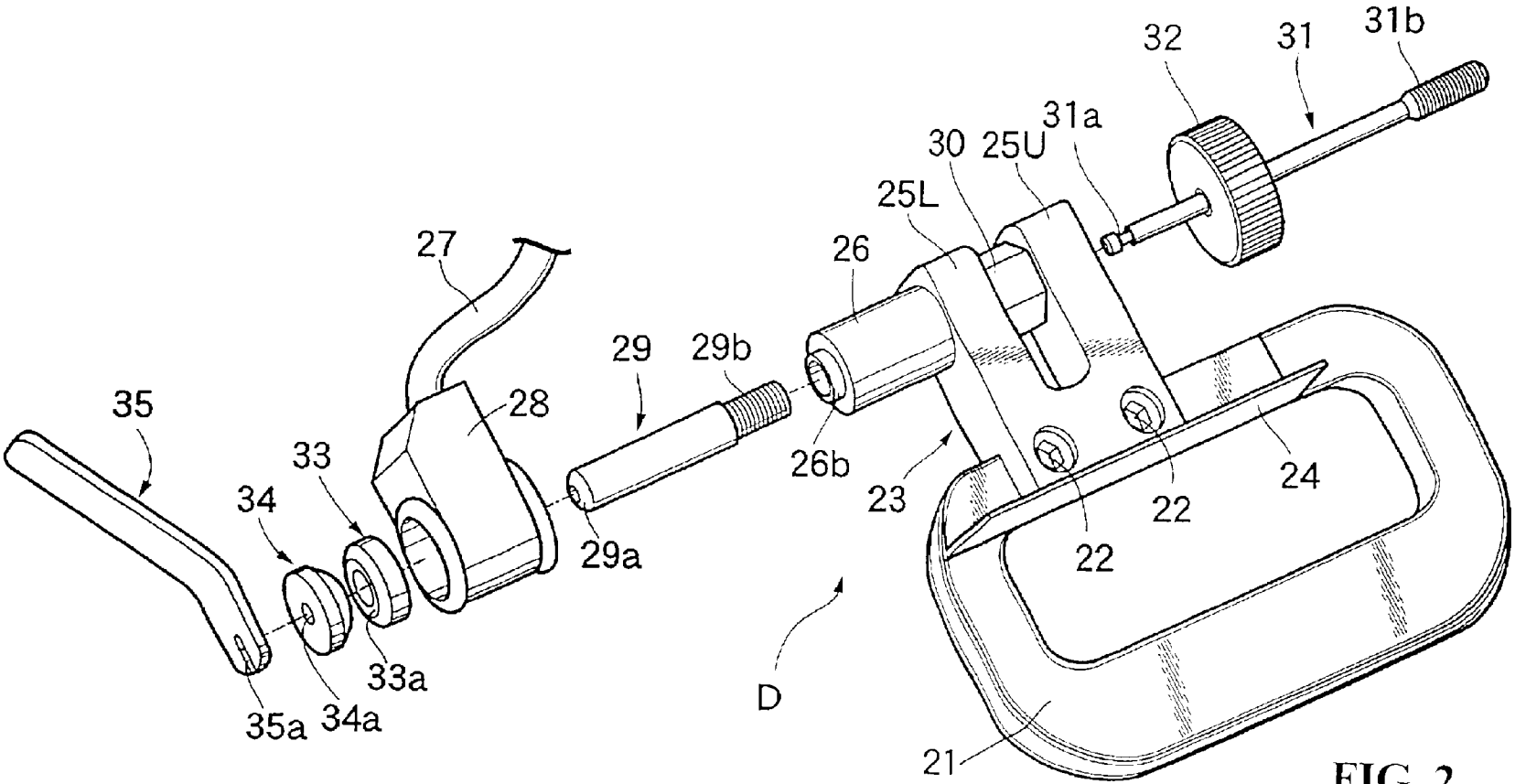
FIG. 2 is an exploded perspective view of the dimpling device shown in FIG. 1.
Figure 3:
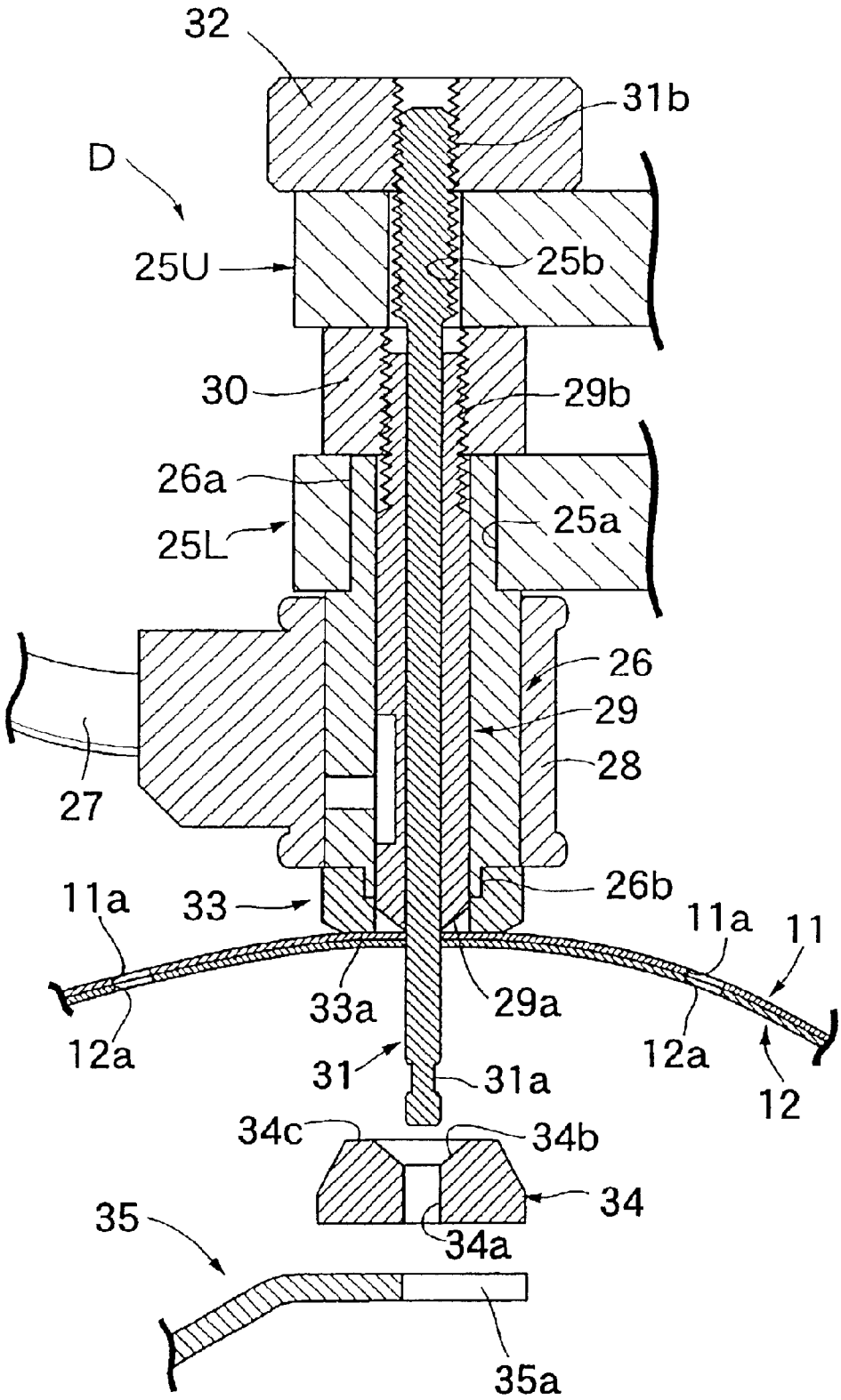
FIG. 3 is a sectional view of the dimpling device in an operating position prior to a setting operation.
Figure 4:
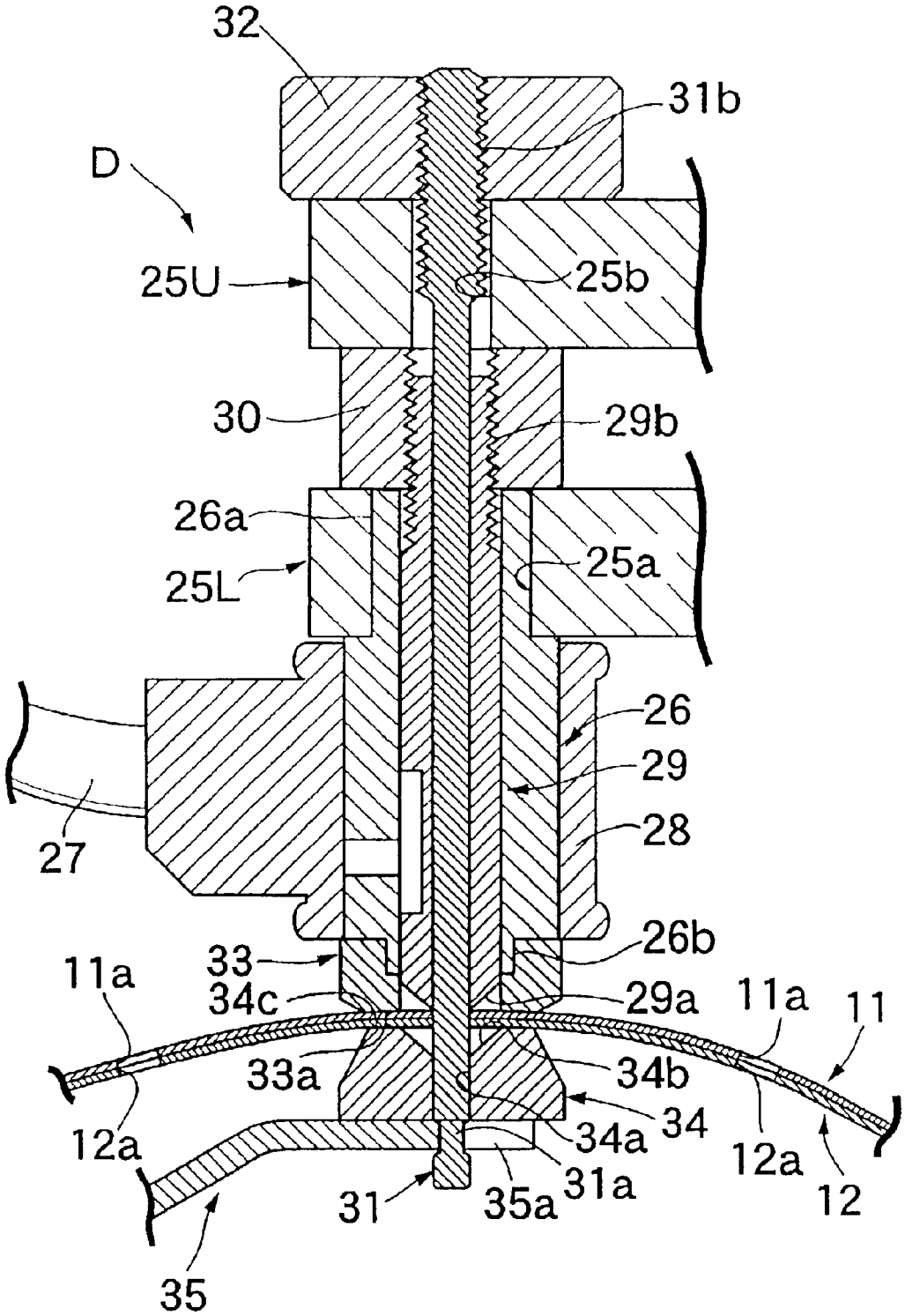
FIG. 4 is a sectional view diagram showing the dimpling device in an operating position upon the completion of a setting operation.
Figure 5:
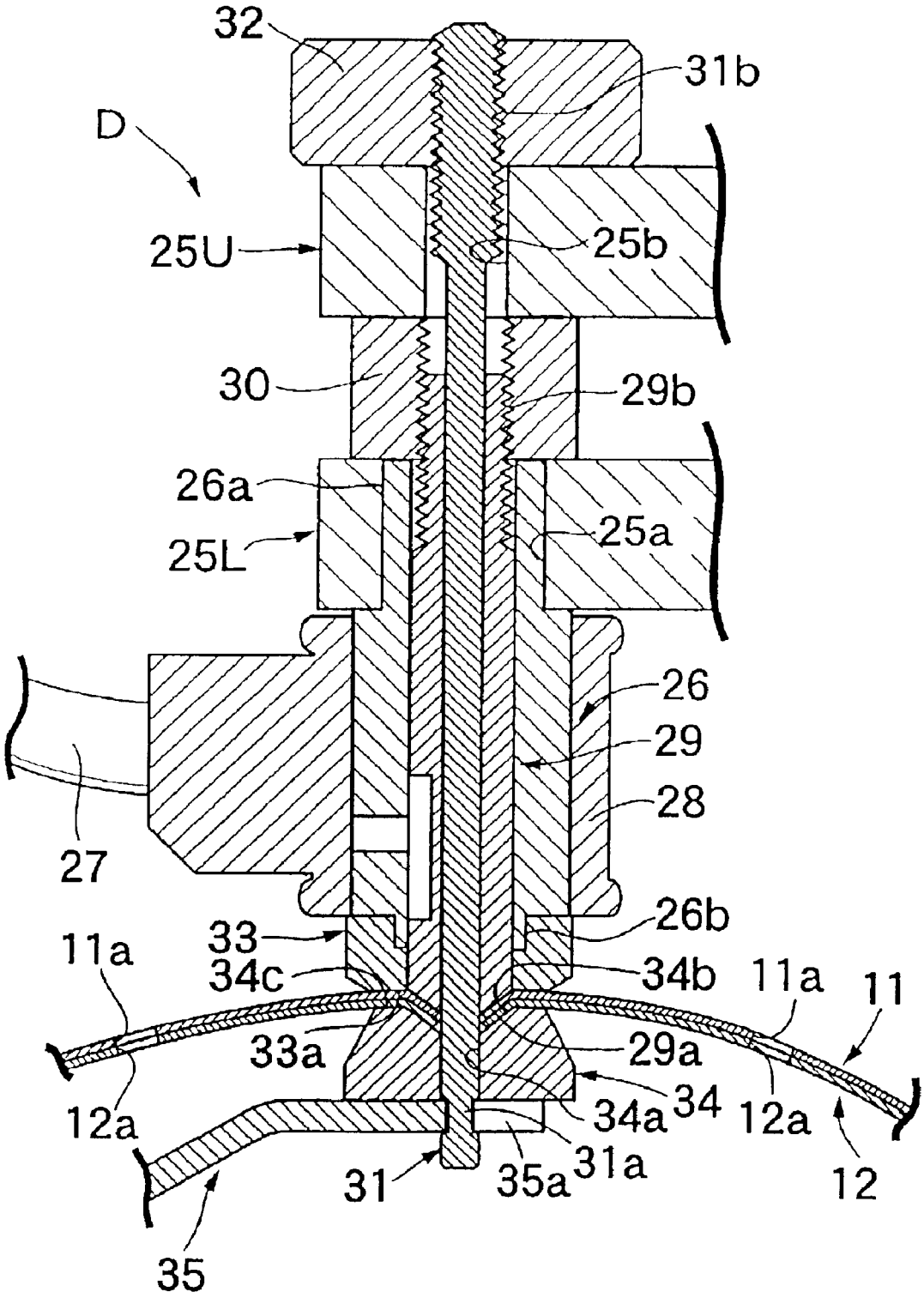
FIG. 5 is a sectional view showing the dimpling device in an operating position upon the completion of a dimpling operation.
Figure 6:
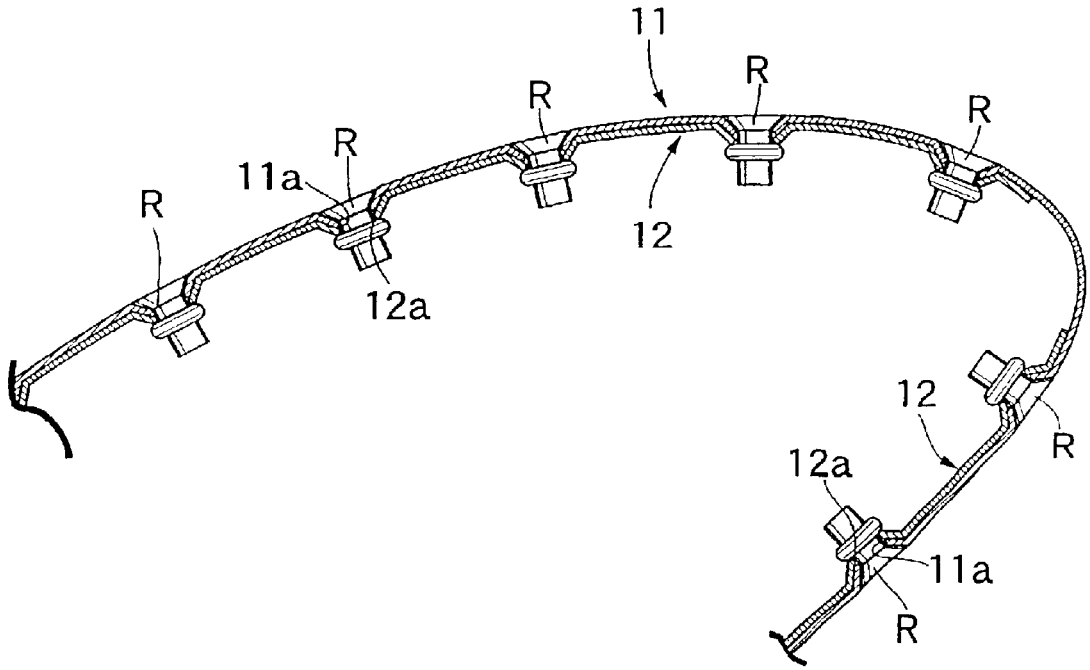
FIG. 6 is a side, sectional view showing workpieces fastened by flush rivets.

The present invention will hereinafter be described with reference to the accompanying drawings. FIGS. 1 to 6 show a first embodiment of the present invention. FIG. 1 is a side view of a dimpling device according to a first embodiment of the present invention. FIG. 2 is an exploded perspective view of the dimpling device shown in FIG. 1. FIG. 3 is a sectional view of the dimpling device in an operating position prior to a setting operation. FIG. 4 is a sectional view diagram showing the dimpling device in an operating position upon the completion of a setting operation. FIG. 5 is a sectional view showing the dimpling device in an operating position upon the completion of a dimpling operation. FIG. 6 is a side, sectional view showing workpieces fastened by flush rivets.

Referring to FIGS. 1 to 3, a dimpling device D of the first embodiment is used for dimpling, e.g., rivet holes 11*a*, 12*a* (see FIG. 3) that have been machined in advance in a section where a skin 11 and a rib flange 12 of a rotor blade of an airplane are to be joined together. The rivet holes 11*a*, 12*a* are dimpled in a shape that is suitable for being fastened by a countersunk or flush rivet R (see FIG. 6) that has a flat head and does not project from the surface of the skin 11.

The dimpling device D is compact in size so that an operator can hold it with their hand to operate it, and may include an annular grip 21 for the operator to grip. A U-shaped stay 23 and a heat-shielding plate 24 having an L-shaped cross section are also provided as shown. The stay 23 and the plate 24 are secured together to the grip 21 by two bolts 22, although any number of bolts can be utilized as necessary.

Through holes 25*a*, 25*b* are coaxially formed in first and second arm parts 25L, 25U, respectively, of the stay 23. A small diameter portion 26*a* of a guide tube 26 is pressed into and fixed within the through hole 25*a* of the lower arm part 25L. An annular heater unit 28 connected to a power source (not illustrated) via a cord 27 is mounted around the outer circumference of the guide tube 26.

A pipe-shaped slide rod 29 is slidably fitted within the guide tube 26. A frustoconical punch 29*a* is formed at the lower end of the slide rod 29, and a male thread 29*b* is formed on the upper end thereof. A nut 30 is disposed between the first and second arm parts 25L, 25R of the stay 23 and is screwed onto the male thread 29*b* of the slide rod 29. A center pin 31 slidably fitted within the slide rod 29. An annular groove 31*a* is formed in the lower end of the center pin 31, and a male thread 31*b* is formed on the upper end of the center pin 31. The male thread 31*b* of the center pin 31 is screwed into a workpiece holder dial 32 that is in contact with the upper face of the first arm part 25U of the stay 23.

An annular-shaped first workpiece holder 33 is detachably fitted onto a step 26*b* at the lower end of the guide tube 26. The first workpiece holder 33 includes a holding surface 33*a* that makes contact with the surface of the skin 11. A second workpiece holder 34 has a through hole 34*a* through which the center pin 31 runs, a frustoconical die 34*b* that works in cooperation with the punch 29*a* of the slide rod 29, and a holding surface 34*c* that makes contact with the back surface of the rib flange 12. A latch member 35 is formed from a plate bent into a "dog-leg" shape and has a slit 35*a* that detachably engages with the annular groove 31*a* of the center pin 31.

The first workpiece holder 33 and the second workpiece holder 34 form a pair of cooperating parts. The holding surfaces 33*a,* 34*c* are curved so as to conform to the curvature of the skin 11 and the rib flange 12. A plurality of sets of the first workpiece holder 33 and the second workpiece holder 34 that have holding surfaces 33*a,* 34*c* conforming to the curvature of each part of the skin 11 and the rib flange 12 are prepared in advance.

The operation of the first embodiment of the present invention having the above-mentioned arrangement is described hereinafter. As shown in FIG. 3, the rivet holes 11*a,* 12*a* are formed in the skin 11 and the rib flange 12 in advance. The center pin 31 of the dimpling device D is inserted into the rivet holes 11*a,* 12*a* from the skin 11 side. For this procedure, the workpiece holder dial 32 is rotated to make the center pin 31 project downward so that the center pin 31 can be inserted sufficiently into the interior of the skin 11 and the rib flange 12. In this state, the through hole 34*a* of the second workpiece holder 34 is fitted around the center pin 31 at its tip end, and the slit 35*a* of the latch member 35 is engaged with the annular groove 31*a* of the center pin 31.

An operator subsequently rotates the workpiece holder dial 32 manually and pulls up the center pin 31, e.g., which has the male thread 31*b* screwed into the workpiece holder dial 32, together with the second workpiece holder 34 and the latch member 35. Accordingly, as shown in FIG. 4, the skin 11 and the rib flange 12 are held between the holding surface 33*a* of the first workpiece holder 33 and the holding surface 34*c* of the second workpiece holder 34.

The use of a preselected set of workpiece holders, e.g., the first workpiece holder 33 and the second workpiece holder 34 are preselected in size and shape, having the holding surfaces 33*a,* 34*c* that conform to the curvature of the skin 11 and the rib flange 12 allows the holding surface 33*a* of the first workpiece holder 33 to make contact with the outer surface of the skin without any appreciable gap therebetween. Further, the holding surface 34*c* of the second workpiece holder 34 is permitted to make contact with the back surface of the rib flange 12 without any appreciable gap therebetween.

Subsequently, as shown in FIG. 5, rotating the nut 30 disposed between the pair of arm parts 25L, 25U of the stay 23 using a tool such as a wrench, pushes the slide rod 29 downward while it is guided by the inner circumferential surface of the guide tube 26 and the outer circumferential surface of the center pin 31. Accordingly, the slide rod 29 presses the skin 11 and the rib flange 12 between the punch 29*a* at the lower end of the slide rod 29 and the die 34*b* of the second workpiece holder 34. The skin 11 and the rib flange 12 are dimpled so as to conform to the shape of the head of the flush rivet R.

In this procedure, since the curvatures of the holding surfaces 33*a,* 34*c* holding the surroundings of the rivet holes 11*a,* 12*a* conform to the curvatures of the skin 11 and the rib flange 12, the skin 11 and the rib flange 12 that are held by the holding surfaces 33*a,* 34*a,* are prevented from deforming.

When dimpling the skin 11 and the rib flange 12 by pressing them between the punch 29*a* and the die 34*b,* the application of heat in the vicinity of the rivet holes 11*a,* 12*a* with heat generated by the heater unit 28 can reduce the load required for dimpling. The hand of the operator holding the grip 21 does not become hot since the heat generated by the heater unit 28 is shielded by the heat shielding plate 24. As shown in FIG. 6, inserting the flush rivets R into the thus-dimpled rivet holes 11*a,* 12*a* and setting the rivets R in place can integrally join the skin 11 and the rib flange 12.

As described herinabove, when dimpling the surroundings of the rivet holes 11*a,* 12*a* into dish or frustoconical shapes by moving the punch 29*a* toward the die 34*b* fixed to the center pin 31 that is inserted into the rivet holes 11*a,* 12*a* of the skin 11 and the rib flange 12, the holding surface 33*a* of the first workpiece holder 33 and the holding surface 34*c* of the second workpiece holder 34 are in intimate contact with the surface of the skin 11 and the back surface of the rib flange 12, e.g., little or no gap is present between these surfaces. Therefore, the skin 11 and the rib flange 12 can be reliably prevented from deforming in the section where they are in contact with the holding surfaces 33*a,* 34*c*.

The first workpiece holder 33 and the second workpiece holder 34 are detachable from the center pin 31. An operator can also preparing a plurality of sets of the first workpiece holder 33 and the second workpiece holder 34 in advance, e.g., having holding surfaces 33*a,* 34*c* that conform to the curvature of each area of the skin 11 and the rib flange 12. Therefore, by pre-selecting and attaching a set of the first workpiece holder 33 and the second workpiece holder 34 having the holding surfaces 33*a,* 34*c* that have a desired curvature, a single dimpling device D can dimple numerous curved areas of the skin 11 and the rib flange 12 having varying curvatures. Accordingly, the multi-purpose feature of the device D is greatly improved with the first embodiment of the present invention.

Furthermore, in a conventional dimpling device having a punch and a die at opposite ends of a C-shaped arm, it is impossible to dimple a portion away from the outer periphery of a workpiece unless the dimensions of the C-shaped arm are increased. However, in accordance with the dimpling device D of the present embodiment, since the center pin 31 from which the second workpiece holder 34 has been detached is inserted through the rivet holes 11*a,* 12*a* in a direction from the outer surface of the skin 11 to the back surface of the rib flange 12, and then the second workpiece holder 34 is mounted on the tip end of the center pin 31, the surroundings of the rivet holes 11*a,* 12*a* positioned away from the outer periphery of the workpiece can be dimpled without problems. The dimpling device D of the first embodiment may also be extremely compact in size. Further, the device D provides efficient, ease of operation since the device D can be operated by an operator holding and operating the device D manually.

Figure 7:
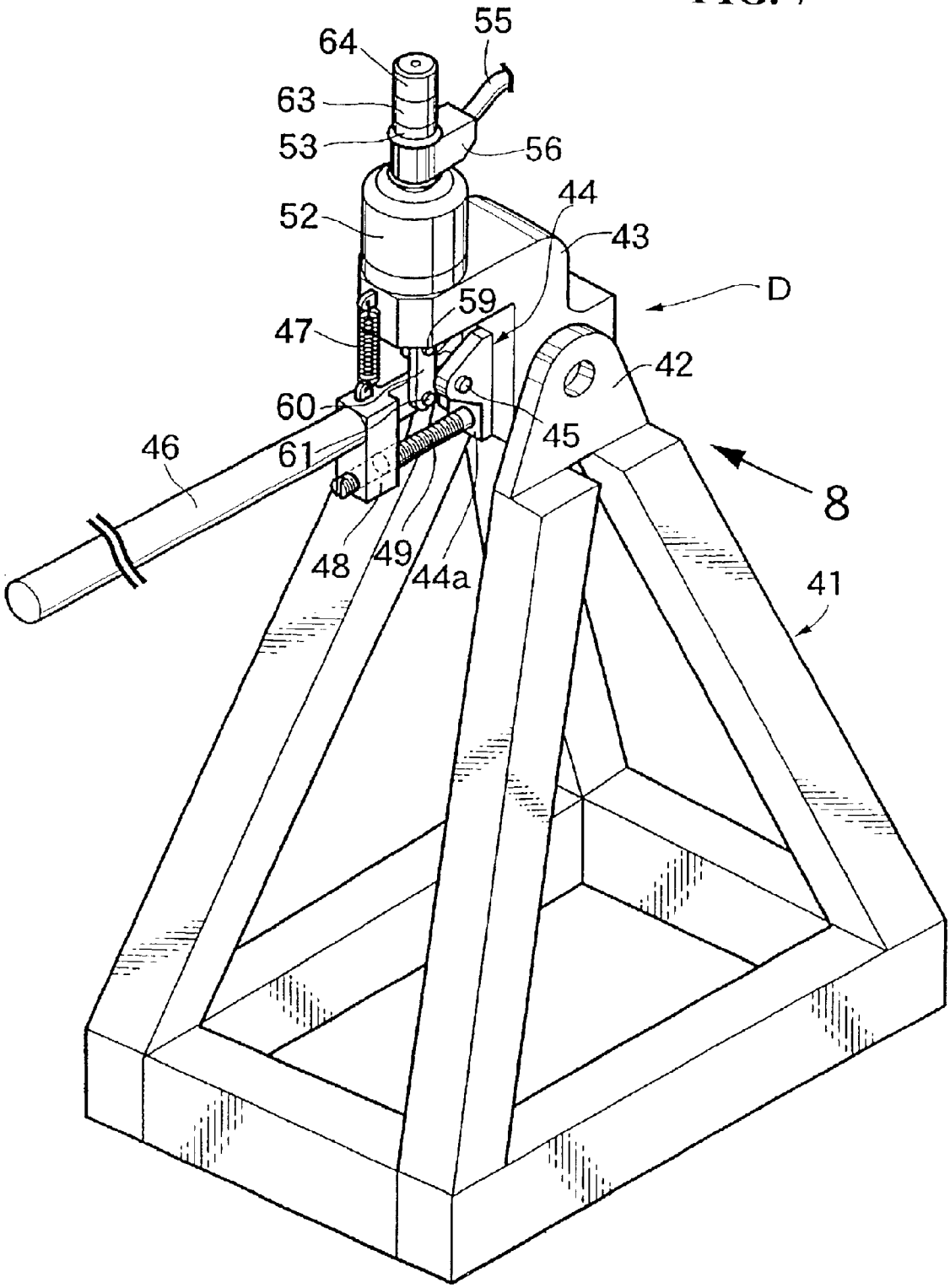
FIG. 7 is a perspective view of a dimpling device according to a second embodiment of the present invention.
Figure 8:
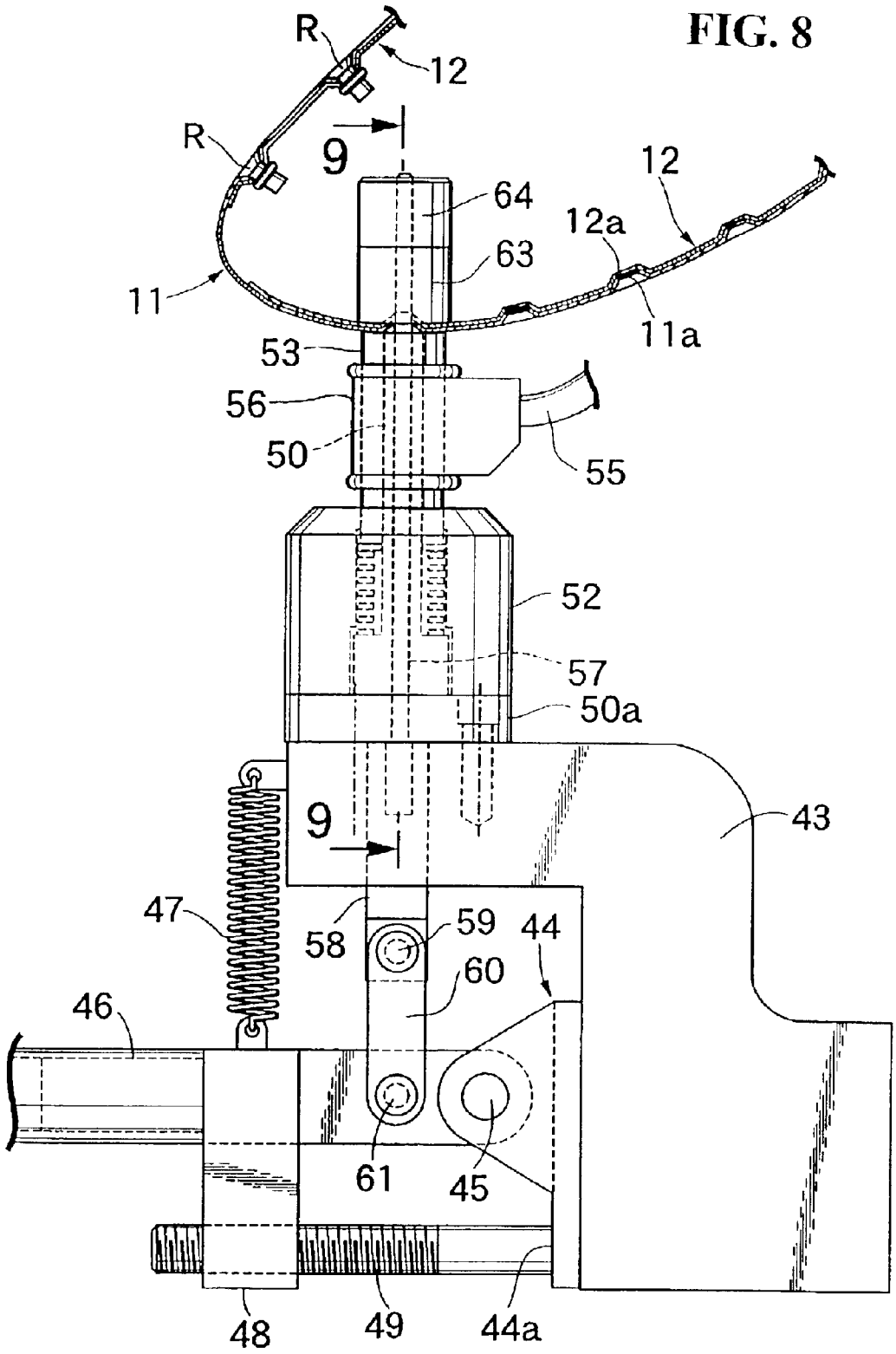
FIG. 8 is a side view of the dimpling device taken along arrow 8 in FIG. 7.
Figure 9:
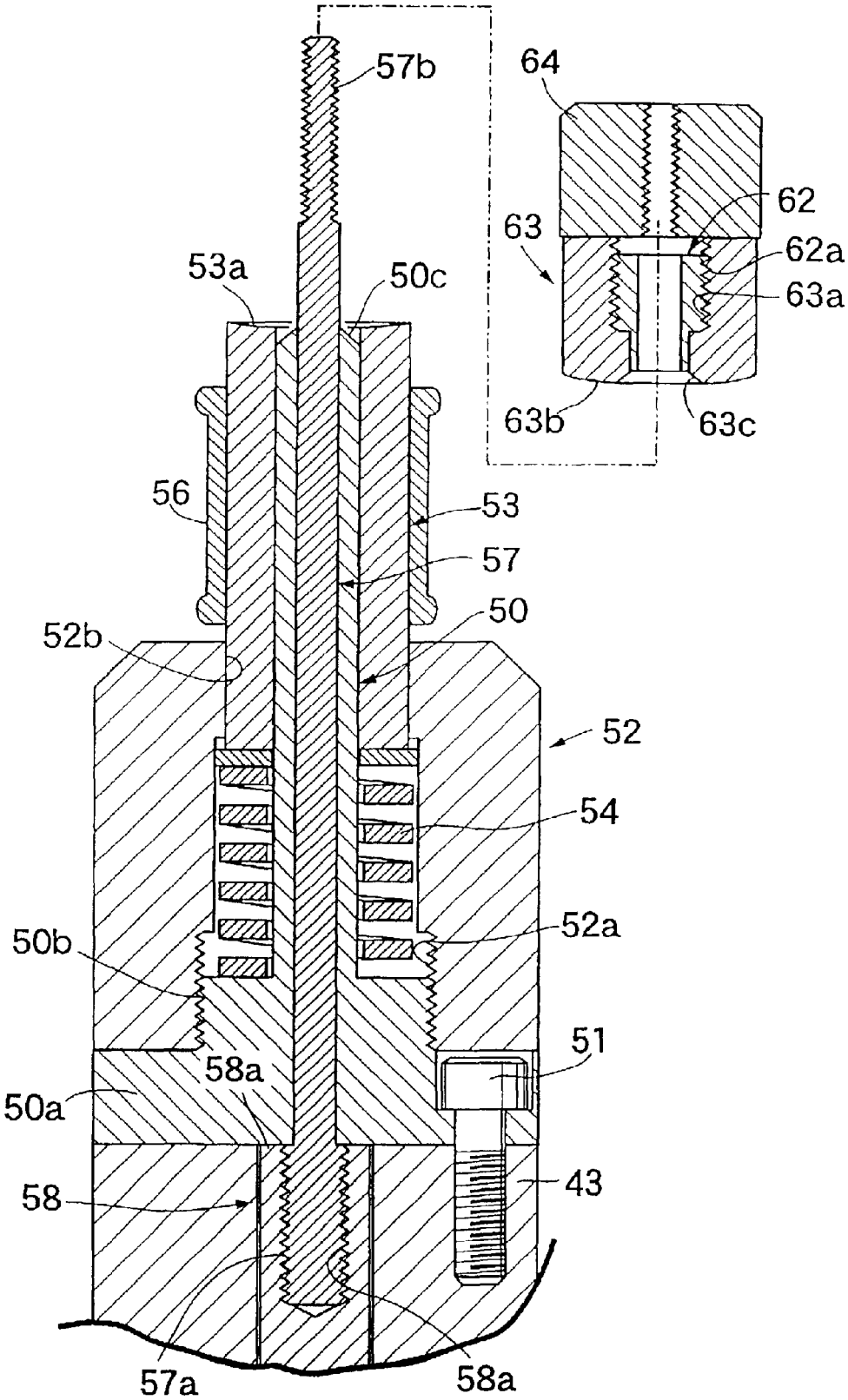
FIG. 9 is a cross sectional view taken along line 9—9 in FIG. 8.
Figure 10:
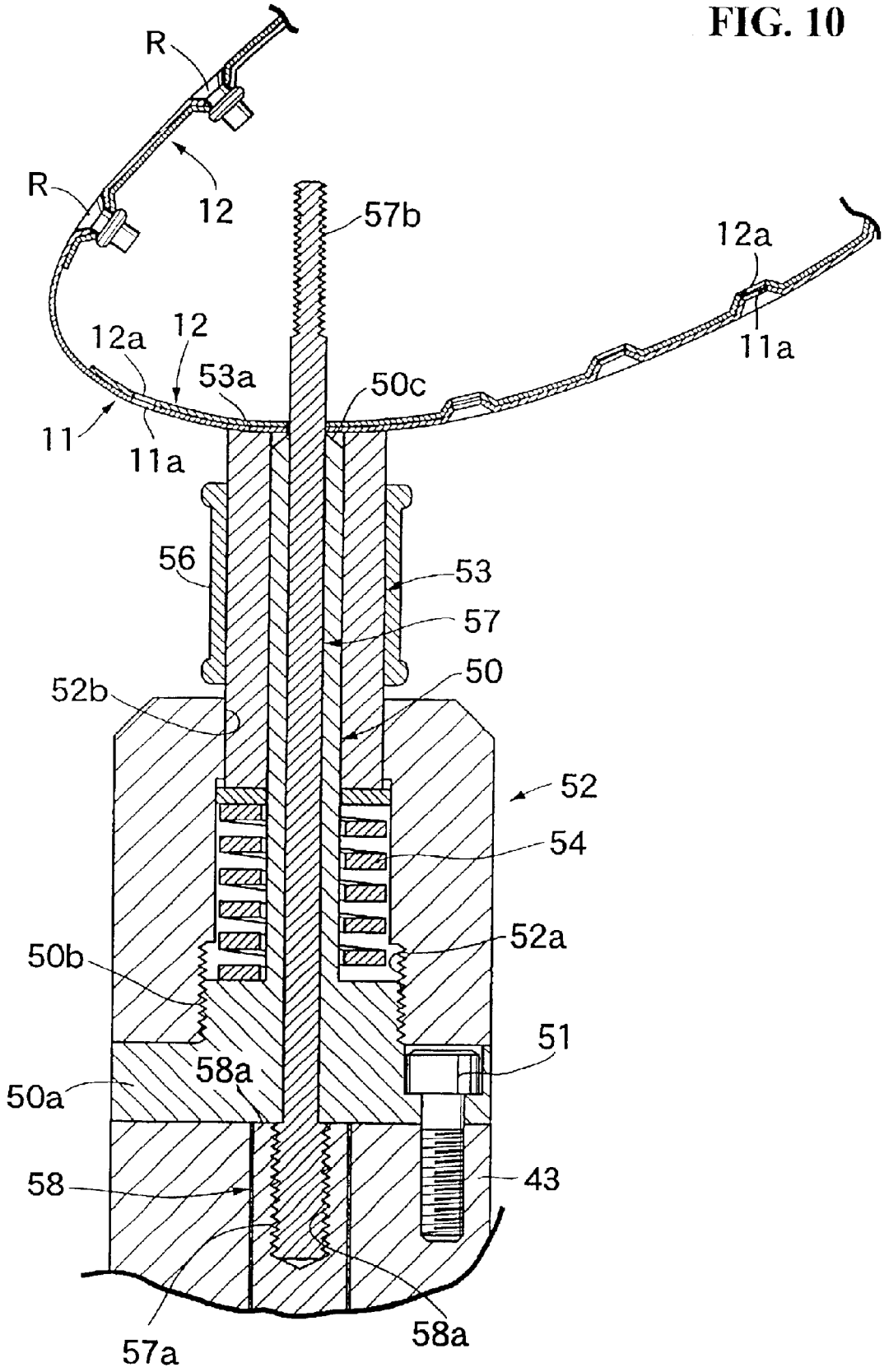
FIG. 10 is a side view of the dimpling device in an operating position prior to a setting operation.
Figure 11:
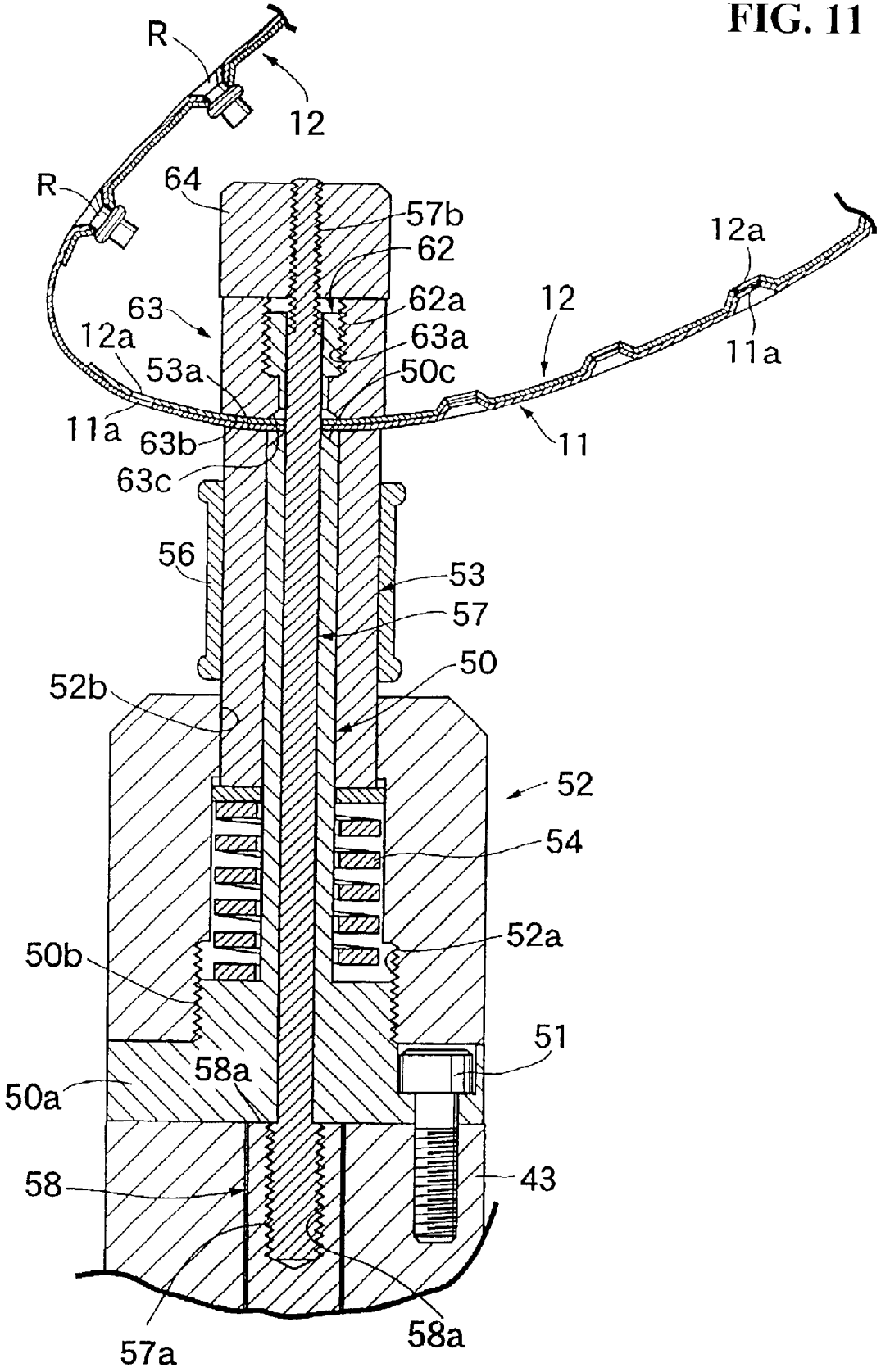
FIG. 11 is a side view of the dimpling device in an operating position upon the completion of the setting operation.
Figure 12:
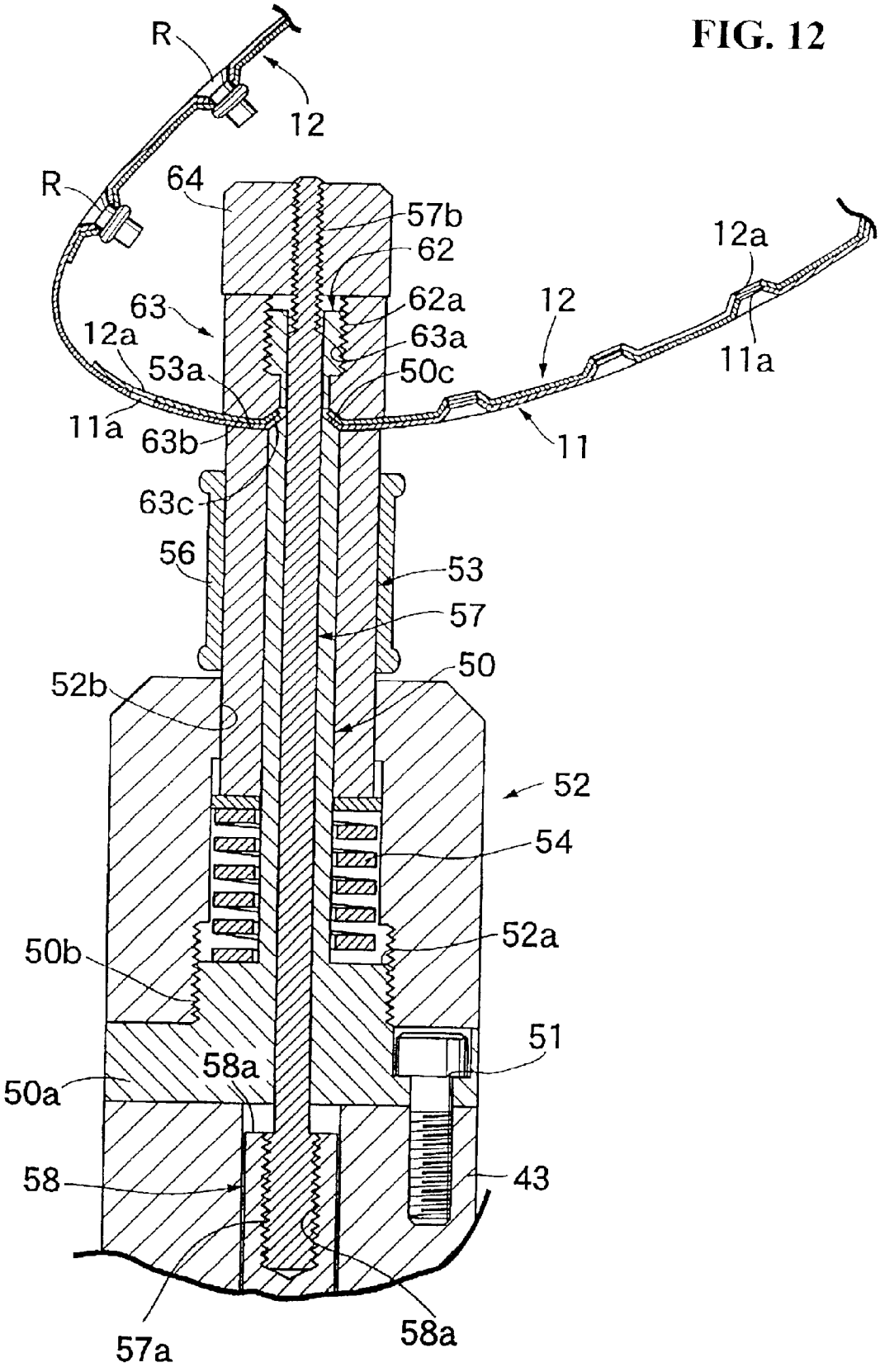
FIG. 12 is a side view of the dimpling device in an operating position upon the completion of a dimpling operation.

FIGS. 7 to 12 are directed toward a second embodiment of the present invention. FIG. 7 is a perspective view of a dimpling device according to a second embodiment of the present invention. FIG. 8 is a side view of the dimpling device taken along arrow 8 in FIG. 7. FIG. 9 is a cross sectional view taken along line 9—9 in FIG. 8. FIG. 10 is a side view of the dimpling device in an operating position prior to a setting operation. FIG. 11 is a side view of the dimpling device in an operating position upon the completion of the setting operation. FIG. 12 is a side view of the dimpling device in an operating position upon the completion of a dimpling operation.

As shown in FIGS. 7 to 9, the dimpling device D of the second embodiment includes a quadrangular pyramidal base 41, and a support block 43 fixed to the top of the base 41 via a pair of brackets 42. The base end of a lever 46 is pivotably supported via a fulcrum pin 45 on a bracket 44 fixed to the support block 43. This lever 46 is urged upward by a return spring 47 disposed between the lever 46 and the support block 43. A stopper bolt 49 is screwed into an arm 48 projecting downward from the vicinity of the base end of the lever 46. The bracket 44 has a stopper face 44*a* with which the extremity of the stopper bolt 49 can make contact.

A flange 50*a* provided at the lower end of a pipe-shaped stationary rod 50 is fixed to the upper surface of the support block 43 by bolts 51. A male thread 50*b* formed on an upper part of the flange 50*a* is screwed into a female thread 52*a* formed in a lower part of an inverted-cup-shaped housing 52. A pipe-shaped first workpiece holder 53 is supported in a vertically slidable manner between the inner circumferential surface of a guide hole 52*b* and the outer circumferential surface of the stationary rod 50. The guide hole 52*b* passes through the upper face of the housing 52. A coil spring 54 having a large spring constant is disposed between the lower face of the first workpiece holder 53 and the upper face of the flange 50*a* of the stationary rod 50.

A frustoconical punch 50*c* is formed at the upper end of the stationary rod 50. A holding surface 53*a* that makes contact with the surface of a skin 11 is formed on the upper end of the first workpiece holder 53 with no gap therebetween. A heat unit 56 is fitted around the outer periphery of the first workpiece holder 53 and is connected to a power source (not illustrated) via a cord 55.

A center pin 57 is fitted in a vertically slidable manner within the stationary rod 50. A male thread 57*a* on the lower end of the center pin 57 is screwed into a female thread 58*a* in the upper end of a connecting rod 58 supported in a vertically slidable manner within the support block 43. The lower end of the connecting rod 58 projecting downward from the lower face of the support block 43 is pivotably supported on the upper end of a link 60 via a connecting pin 59. A lower end of the link 60 is pivotably supported in the vicinity of the base end of the lever 46 via a connecting pin 61.

A guide member 62 fits slidably around the vicinity of the upper end of the center pin 57. A male thread 62*a* formed on the outer circumference of the guide member 62 is screwed into a female thread 63*a* formed on the inner circumference of a second workpiece holder 63. A holding surface 63*b* that makes contact with the back surface of a rib flange 12 is formed on the lower surface of the second workpiece holder 63 with no gap therebetween. A die 63*c* works in cooperation with the punch 50*c*. A workpiece holder dial 64 is screwed onto a male thread 57*b* formed on the upper end of the center pin 57.

The lever 46 is normally urged upward by the elastic force of the return spring 47, and the connecting rod 58 moves upward via the link 60. However, the stopper face 58*b* on the upper end of the connecting rod 58 makes contact with the lower face of the flange 50*a* of the stationary rod 50, thereby restricting the end of the upward swing of the lever 46.

The operation of the second embodiment of the present invention having the above-mentioned arrangement is described hereinafter. As shown in FIG. 10, the workpiece holder dial 64, the guide member 62, and the second workpiece holder 63 are removed from the center pin 57. The thus-exposed upper end of the center pin 57 is inserted into rivet holes 11*a*, 12*a* preformed in the skin 11 and the rib flange 12. As shown in FIG. 11, the guide member 62 to which the second workpiece holder 63 is attached is subsequently inserted from the upper end of the center pin 57, and the workpiece holder dial 64 is screwed onto the male thread 57*b* on the upper end of the center pin 57.

Accordingly, the skin 11 and the rib flange 12 are held between the holding surface 53*a* of the first workpiece holder 53 and the holding surface 63*b* of the second workpiece holder 63. Since a preselected set of the first workpiece holder 53 and the second workpiece holder 63 are used having holding surfaces 53*a*, 63*b* that conform to the curvature of the skin 11 and the rib flange 12, the holding surface 53*a* of the first workpiece holder 53 makes contact with the surface of the skin 11 without any appreciable therebetween. The holding surface 63*b* of the second workpiece holder 63 makes contact with the back surface of the rib flange 12 without any gap therebetween.

Subsequently, when the operator holds the tip end of the lever 46 and presses it downward against the elastic force of the return spring 47, the link 60 connected to the lever 46 descends together with the connecting rod 58 and the center pin 57. The second workpiece holder 63 supported on the upper end of the center pin 57 also descends. When the second workpiece holder 63 descends as shown in FIG. 12, the first workpiece holder 53 descends while compressing the coil spring 54 via the skin 11 and the rib flange 12. Accordingly, the skin 11 and the rib flange 12 are pressed between the die 63*c* of the descending second workpiece holder 63 and the punch 50*c* on the upper end of the stationary rod 50. The skin 11 and the rib flange 12 are dimpled so as to conform to the shape of the head of a flush rivet R. In this procedure, the curvatures of the holding surfaces 53*a*, 63*b* holding the surroundings of the rivet holes 11*a*, 12*a* conform to the curvatures of the skin 11 and the rib flange 12, thereby preventing deformation of the skin 11 and the rib flange 12 held by the holding surfaces 53*a*, 63*b*.

When dimpling the skin 11 and the rib flange 12 by clamping them between the punch 50*c* and the die 63*c*, the load required for dimpling can be reduced by heating the vicinity of the rivet holes 11*a*, 12*a* with heat generated by the heater unit 56. In accordance with the second embodiment explained above, the same effects as those obtained in the first embodiment can be achieved. In particular, in the second embodiment, merely pressing the lever 46 downward can initiate and accomplish dimpling of the rivet holes, thereby reducing the operator's labor and time for operation.

Embodiments of the present invention have been described in detail above, but the present invention can be modified in a variety of ways without departing from the spirit and scope of the invention. For example, the embodiments illustrate the skin 11 and the rib flange 12 of a rotor blade of an airplane, but the present invention can also be applied to any other workpiece requiring a riveted connection. In the foregoing embodiments, the punches 29*a*, 50*c* are in the form of a projection and the dies 34*b*, 63*c* are in the form of a recess, but the punches 29*a*, 50*c* may alternatively be in the form of a recess and the dies 34*b*, 63*c* may be in the form of a projection.

As described above, in accordance with the first aspect of the present invention, when the punch and the die approach each other along the center pin inserted into the rivet holes of the workpieces and dimpling the surroundings of the rivet holes into dish shapes, the holding surface of the first workpiece holder and the holding surface of the second workpiece holder make contact with the surfaces of both workpieces without any appreciable gap therebetween. Therefore, even when the workpieces have a curvature in the vicinity of the rivet holes, it is possible to prevent the workpieces from deforming where they are in contact with the holding surfaces.

Since the first workpiece holder and the second workpiece holder are detachable from the center pin, attaching the first workpiece holder and the second workpiece holder whose holding surfaces have a curvature corresponding to the curvature of the workpieces to be machined can accommodate workpieces having various curvatures. Accordingly, the multi-purpose features of the dimpling device can be improved.

Since the second workpiece holder is detachable from the tip end of the center pin after the second workpiece holder is removed from the center pin and the center pin is inserted into the rivet holes from a surface on one side of the workpiece, the second workpiece holder can be attached to the tip end of the center pin from the surface on the opposing side of the workpieces. Therefore, the dimpling of the surroundings of the rivet holes positioned away from the outer peripheries of the workpieces can be carried out without problems, e.g. such as distortion of the workpiece surfaces.

In accordance with the second aspect of the present invention, since the vicinity of the rivet holes of the workpieces is heated by the heater unit, it is possible to reduce the load that is required to plastically deform the workpieces when using the punch and die, thereby improving the workability of the device and workpieces. In accordance with the third aspect of the present invention, since a set of workpiece holders is preselected for use, e.g., according to the curvature of the vicinity of the rivet holes of the workpieces from a plurality of preprepared sets of first workpiece holders and second workpiece holders whose holding surfaces have different curvatures, it is possible to accommodate workpieces having various curvatures relatively easily and while improving the multi-purpose features of the dimpling device.

One of skill in the art will appreciate that the workpieces of the present invention may correspond to a skin 11 and a rib flange 12 of an airplane or other structure in the foregoing embodiments, the center pin driving means of the present invention corresponds to a nut 30 and a lever 46 in the foregoing embodiments, and the workpiece holder driving means of the present invention corresponds to work holder dials 32, 64 in the foregoing embodiments The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A dimpling device for dimpling surrounding areas of rivet holes preformed in superimposed first and second workpieces into dish shapes in order to fasten the superimposed workpieces by a flush rivet, the dimpling device comprising:

a center pin capable of being inserted into the rivet holes of the workpieces and having a tip end;

a punch slidably fitted around an outer periphery of the center pin and capable of making contact with a working surface of the first workpiece;

a first workpiece holder slidably and detachably fitted around an outer periphery of the punch and having a holding surface capable of making contact with the working surface of the first workpiece without an appreciable gap therebetween;

a second workpiece holder detachably engaged with the tip end of the center pin and having a holding surface capable of making contact with a working surface of the second workpiece without any appreciable gap therebetween;

a die integrally formed with the second workpiece holder and cooperatively engaging said punch during a dimpling operation;

means for driving said workpiece holders for making the first workpiece holder and the second workpiece holder approach each other along an axial direction of the center pin, wherein the working surfaces of said first and second workpieces are held therebetween; and means for driving said center pin for moving the center pin in the axial direction so as to dimple the surrounding areas of the rivet holes with the punch and the die into dish shapes.

2. The dimpling device according to claim 1, further comprising a heater unit for heating the vicinity of the rivet holes of the first and second workpieces.

3. The dimpling device according to claim 1, further comprising a plurality of sets of first workpiece holders and second workpiece holders respectively having holding surfaces with different curvatures.

4. The dimpling device according to claim 2, further comprising a plurality of sets of first workpiece holders and second workpiece holders respectively having holding surfaces with different curvatures.

5. The dimpling device according to claim 1, further comprising:

an annular grip;

a U-shaped stay; and a heat-shielding plate having an L-shaped cross section, wherein the stay and the plate are secured together to the grip by at least one bolt.

6. The dimpling device according to claim 5, further comprising:

a first arm part and a second arm part formed in said stay;

through holes coaxially formed in said first and second arm parts;

a guide tube having a small diameter portion is pressed into and fixed within the through hole of the second arm part; and an annular heater unit mounted around an outer circumference of the guide tube.

7. The dimpling device according to claim 6, further comprising a pipe-shaped slide rod slidably fitted within the guide tube;

a frustoconical punch formed at a lower end of the slide rod and a male threaded portion formed on the upper end thereof; and a nut being disposed between the first and second arm parts of the stay and screwed onto the male threaded portion of the slide rod; wherein the center pin is slidably fitted within the slide rod.

8. The dimpling device according to claim 7, further comprising:

an annular groove being formed in a lower end of the center pin;

a male threaded portion being formed on an upper end of the center pin; and a workpiece holder dial in contact with an upper face of the first arm part of the stay.

9. The dimpling device according to claim 1, further comprising:

an annular groove being formed in a lower end of the center pin;

a male threaded portion being formed on an upper end of the center pin; and a workpiece holder dial engaged with the male threaded portion of the center pin.

10. The dimpling device according to claim 1, further comprising a latch member cooperatively engaging said center pin.

11. The dimpling device according to claim 1, further comprising: p1 a quadrangular pyramidal base;

a support block fixed to a top portion of the base via a pair of brackets; and a lever, said lever including a base end pivotably supported via a fulcrum pin fixed to the support block.

12. The dimpling device according to claim 11, further comprising a return spring disposed between the lever and the support block, wherein the lever is urged upward by the return spring.

13. The dimpling device according to claim 12, further comprising:

an inverted, cup-shaped housing;

a pipe-shaped stationary rod fixed to an upper surface of the support block;

a flange provided at a lower end of the pipe-shaped stationary rod; and a male threaded portion formed on an upper part of the flange and a corresponding female threaded portion formed in a lower part of the inverted, cup-shaped housing.

* * * * *